US005325273A

United States Patent [19]

Kuo

[11] Patent Number: 5,325,273

[45] Date of Patent: Jun. 28, 1994

[54] LIGHTING BAR

[76] Inventor: Ming-Shish Kuo, 26-1, Alley 43, Lane 344, Jong-Jeng Road, Yung-Kang City, Tainan Shien, Taiwan

[21] Appl. No.: 120,773

[22] Filed: Sep. 15, 1993

[51] Int. Cl.[5] ..... F21K 2/00; B65D 25/08

[52] U.S. Cl. ..... 362/34; 362/84; 362/159; 206/219

[58] Field of Search ..... 362/34, 84, 159; 206/219

[56] References Cited

U.S. PATENT DOCUMENTS 3,576,987 5/1971 Voight ..... 362/34

5,043,851 8/1991 Kaplan ..... 362/34

*Primary Examiner*—Ira S. Lazarus

*Assistant Examiner*—Sara Sachie Raab

[57] ABSTRACT

A lighting bar having an elastic transparent tube with its interior divided with two or more chambers for containing different chemicals separately in the chambers, the elastic tube being able to be bent for forcing a dividing thin film of the chambers to break so as to let the chemicals mix together to produce light.

1 Claim, 4 Drawing Sheets

LIGHTING BAR

BACKGROUND OF THE INVENTION

A conventional lighting bar 1, as shown in FIG. 1, comprises a semi-transparent tube 10, and two kinds of chemicals sealed separately by a small glass tube 11 in the tube 10. The small tube 11 is easily broken by bending the tube 2 so as to mix the two chemicals together to produce light.

The conventional lighting bar 1 is rather complicated in manufacturing by separately make the tube 10 and the small tube 11 11, and sealing a first kind of chemical such as oxalic acid in the small glass tube 11 and a second kind of chemical such as peroxide in the tube 10. So it cannot be continuously made by injecting process, nor by filling chemicals by an assembly line process.

SUMMARY OF THE INVENTION

This invention has been devised to offer a kind of lighting bar that can be made of material as economically as possible by a speedy injecting and assembly line process.

A lighting bar in the present invention has a feature that a tubular body has its interior divided into two or more chambers for containing chemicals separated by a thin film liable to be broken by bending the tubular body made of elastic material so as to mix together the chemicals for producing light.

The lighting bar in the present invention has planned to have the following advantages.

1. It can be manufactured in mass production, by injecting and assembly line process.
2. Its cost is very low, satisfying economic principle.
3. Its manufacturing process is simple, quickening its operation.

DETAILED DESCRIPTION OF THE INVENTION

Figure 1:
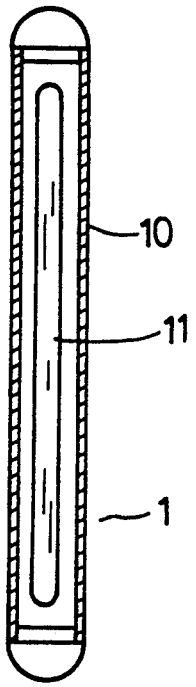
FIG. 1 (PRIOR ART)
FIG. 1 is a cross-sectional view of a conventional lighting bar.
Figure 2:
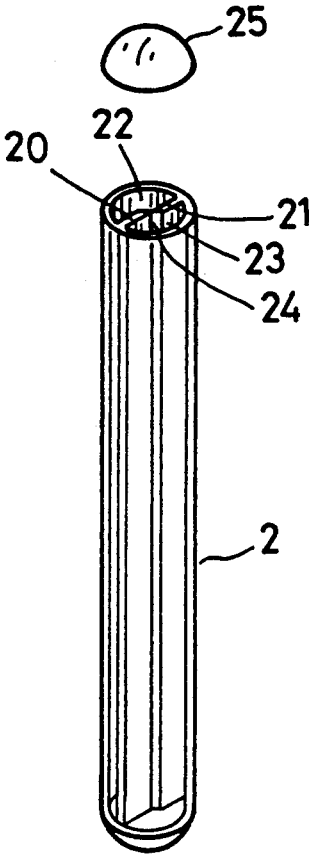
FIG. 2 is an exploded perspective view of a lighting bar in the present invention.
Figure 3:
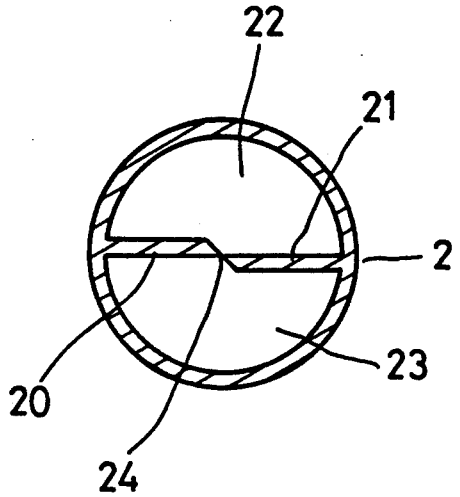
FIG. 3 is a cross-sectional view of the lighting bar in the present invention.

A lighting bar in the present invention, as shown in FIGS. 2 and 3, comprises an elastic transparent tube 2, two separating plates 20, 21 extending lengthwise from an inner opposite wall of the tube 2 to the center radially to divide the interior of the tube 2 into two chambers 22, 23, the inner ends of the two plates 20, 21 being connected with a thin film as a common boundary of the two chambers 22, 23.

In manufacturing, the tube 2 is made by means of injecting process, and then chemicals such as oxalic acid solution, peroxide solution are filled in the two chambers 22, 23. After the tube 2 is cut to the desired length, a cap is used to seal the top of the tube 2. It is therefore not necessary to fill the chemicals in separate small tubes and seal them in the tube 2 as processed in making a conventional lighting bar.

Figure 4:
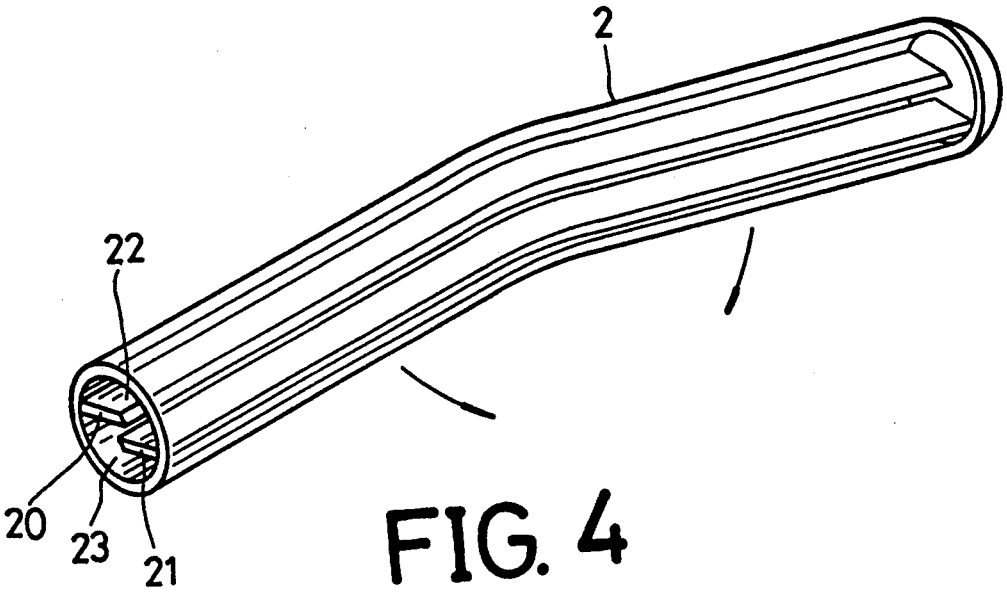
FIG. 4 is a cross-sectional view of the lighting bar in the present invention, showing a chemical reaction caused by two or more chemicals in the chambers in the lighting bar mixed together by bending the lighting bar.
Figure 5:
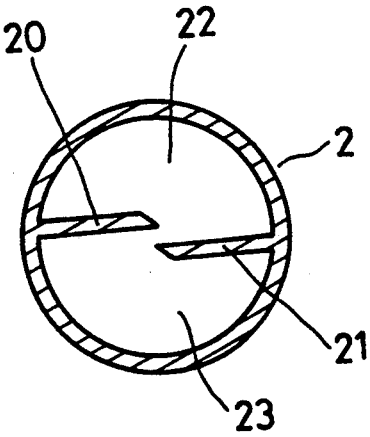
FIG. 5 is a cross-sectional view of FIG. 4.

In using, a user bends the elastic tube 2, forcing the two plates 20, 21 to bend also and compelling the thin film 24 to break to enable the chemicals in the chambers 22, 23 to mix together for producing light as shown in FIGS. 4 and 5.

Figure 6:
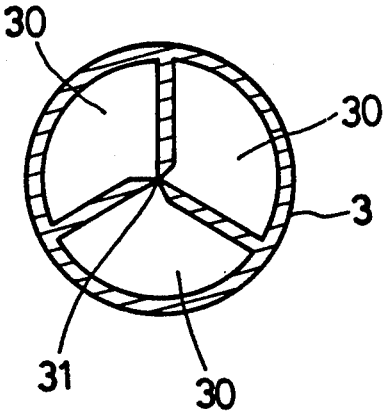
FIG. 6 is a cross-sectional view of another embodiment of the lighting bar in the present invention.

Another embodiment of the lighting bar is shown in FIG. 6, an elastic transparent tube 3 is provided with three or more chambers 30 divided by separating plates just as those chambers 22, 23 by the plates 20, 21 in the first embodiment, and a thin film 31 is provided to connect the inner ends of the plates as a common boundary of the chambers of chemicals so as to be used in the same way as the first embodiment of the lighting bar.

The scope of this invention is not limited to the embodiments above mentioned, but should include variations based on the theory of this invention.

What is claimed is:

1. A lighting bar comprising:

an elastic transparent tube made from a chemically stable material, the two ends of said tube being sealed to enclose two or more chemicals therein;

said chemicals being contained in two or more separate chambers formed by partition segments integral to the tube, the partition segments extending lengthwise for the entire length of the tube in the interior of said tube, said partition segments thereby forming two or more discrete chambers; such that when said elastic tube is bent by a user, the partition segments are easily broken, thus allowing the chemicals to mix together, thereby causing a reaction that produces light.

* * * * *